US011486601B2

(12) United States Patent
Qin et al.

(10) Patent No.: US 11,486,601 B2
(45) Date of Patent: Nov. 1, 2022

(54) WALL-MOUNTED AIR CONDITIONER INDOOR UNIT AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Qiang Qin, Foshan (CN); Kuifang Zou, Foshan (CN); Qiankun Liu, Foshan (CN); Xidong Wang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 340 days.

(21) Appl. No.: 16/675,964

(22) Filed: Nov. 6, 2019

(65) Prior Publication Data

US 2020/0200429 A1 Jun. 25, 2020

Related U.S. Application Data

(63) Continuation of application No. PCT/CN2019/109345, filed on Sep. 30, 2019.

(30) Foreign Application Priority Data

Dec. 25, 2018 (CN) ..... 201822194044.9

(51) Int. Cl.
*F24F 13/02* (2006.01)
*F24F 1/0057* (2019.01)
*F24F 13/20* (2006.01)

(52) U.S. Cl.
CPC ..... *F24F 13/0254* (2013.01); *F24F 1/0057* (2019.02); *F24F 13/20* (2013.01); *F24F 2013/205* (2013.01)

(58) Field of Classification Search
CPC ..... F24F 13/0254; F24F 13/20; F24F 1/0057; F24F 2013/205
See application file for complete search history.

(56) References Cited

U.S. PATENT DOCUMENTS

2008/0111151 A1* 5/2008 Teraki ..... H01L 25/162 257/E23.098
2011/0048050 A1* 3/2011 Moteki ..... F24F 13/32 62/263
2017/0138613 A1* 5/2017 Bai ..... F24F 1/0057

FOREIGN PATENT DOCUMENTS

CN 106765594 A 5/2017
CN 107062397 A 8/2017
(Continued)

OTHER PUBLICATIONS

World Intellectual Property Organization (WIPO) Written Opinion for PCT/CN2019/109345 dated Sep. 30, 2019 10 Pages(Translation Included ).

(Continued)

*Primary Examiner* — Emmanuel E Duke
(74) *Attorney, Agent, or Firm* — Anova Law Group PLLC

(57) ABSTRACT

An air conditioner indoor unit includes a housing, a chassis, and an air duct assembly. The housing includes a face frame including an inner cavity having an opening. The chassis covers a side of the face frame. The air duct assembly includes a mounting bracket movably mounted at the chassis and detachably connected with the face frame. The mounting bracket is configured to move into or out of the inner cavity through the opening of the inner cavity along an insertion direction.

20 Claims, 9 Drawing Sheets

(56) References Cited

FOREIGN PATENT DOCUMENTS

| | | | |
|---|---|---|---|
| CN | 107388374 | A | 11/2017 |
| CN | 107420987 | A | 12/2017 |
| CN | 107490073 | A | 12/2017 |
| CN | 207094789 | U | 3/2018 |
| CN | 207763073 | U | 8/2018 |
| CN | 108613256 | A | 10/2018 |
| CN | 207936328 | U | 10/2018 |
| CN | 208124576 | U | 11/2018 |
| CN | 209263164 | U | 8/2019 |
| JP | 2004293887 | A | 10/2004 |
| JP | 2012107816 | A | 6/2012 |
| WO | 2018133207 | A | 7/2018 |

OTHER PUBLICATIONS

The European Patent Office (EPO) Extended Search Report for EP Application No. 19795440.7 dated May 11, 2020 8 Pages.

World Intellectual Property Organization (WIPO) International Search Report for PCT/CN2019/109345 dated Sep. 30, 2019 25 Pages(Translation Included ).

Japan Patent Office (JPO) The Notice of Reasons for Refusal For JP Application No. 2019-561866 dated Jan. 4, 2022 6 Pages (Translation Included).

Japan Patent Office (JPO) The Decision to Grant a Patent For JP Application No. 2019-561866 dated Feb. 1, 2022 5 Pages (Translation Included).

Intellectual Property Korea (IPK) The Second Office Action For KR Application No. 10-2019-7033704 dated May 27, 2021 16 Pages (Translation Included ).

Japan Patent Office Reasons for Refusal For Japanese Application No. 2019561866 dated Apr. 27, 2021 11 Pages (including English translation).

Intellectual Property Korea (IPK) The Office Action For KR Application No. 10-2019-7033704 dated Oct. 27, 2020 17 Pages (Translation Included ).

* cited by examiner

WALL-MOUNTED AIR CONDITIONER INDOOR UNIT AND AIR CONDITIONER

CROSS-REFERENCE TO RELATED APPLICATIONS

This application is a continuation of PCT Application No. PCT/CN2019/109345, filed on Sep. 30, 2019, which claims priority to Chinese Patent Application No. 201822194044.9, entitled "WALL-MOUNTED AIR CONDITIONER INDOOR UNIT AND AIR CONDITIONER," filed on Dec. 25, 2018, the entire contents of both of which are incorporated herein by reference.

FIELD

The present disclosure relates to the field of air conditioning technology, and in particular to a wall-mounted air conditioner indoor unit and an air conditioner.

BACKGROUND

A wall-mounted air conditioner indoor unit includes a chassis, a face frame, a panel, a heat exchanger, an air duct assembly, etc. The air duct assembly is prone to deposit dust during the long-term work and needs to be cleaned regularly. It could be very difficult to clean the air duct assembly of the indoor unit. It is usually needed to first remove the panel, the face frame, and the heat exchanger to expose the air duct assembly, and then the air duct assembly could be removed for cleaning. Therefore, the dismounting and mounting of the air duct assembly of the indoor unit is very complicated, which is inconvenient for cleaning.

SUMMARY

The main purpose of the present disclosure is to provide a wall-mounted air conditioner indoor unit, aiming at solving the technical problem of inconvenience in disassembly and assembly of an existing air duct assembly of a wall-mounted air conditioner indoor unit.

In order to achieve the above purpose, the present disclosure provides a wall-mounted air conditioner indoor unit, including:

a housing including a face frame;

a chassis covering a rear side of the face frame to form an inner cavity having a downward opening; and an air duct assembly including a mounting bracket movably mounted to the chassis and detachably connected with the face frame, where the mounting bracket is configured to move into or out of the inner cavity through the opening of the inner cavity along an up-down direction.

In an embodiment, the face frame includes a cross beam extending along a length direction of the housing, and the mounting bracket is screwed or snap-fitted with the cross beam.

In an embodiment, the mounting bracket includes an insertion member, where the chassis includes a sliding slot, and the insertion member is movable in the sliding slot.

In an embodiment, the chassis includes a base plate and two side plates extending forwards from two ends of the base plate, respectively, where the sliding slot is one of two sliding slots, and each sliding slot is formed at a corresponding side plate.

In an embodiment, each of the two ends of the base plate includes a limit slot adjacent to the corresponding sliding slot, and a locking latch is disposed in each limit slot; the insertion member is one of two insertion members, and each insertion member includes a locking slot corresponding to a locking latch.

In an embodiment, each of two ends of the mounting bracket includes a first screw hole respectively, and each of the two side plates includes a second screw hole respectively, where each second screw hole corresponds to a first screw hole, and the mounting bracket is fixed with the chassis by a screw inserting into each first screw hole and each corresponding second screw hole.

In an embodiment, the sliding slot includes a front slot wall inclined forwards from top to bottom, and an angle $\alpha$ between the front slot wall and a vertical direction is at least 0° and at most 89°.

In an embodiment, the air duct assembly further includes a volute assembly disposed at the mounting bracket.

In an embodiment, the volute assembly includes a volute, and a limit plate extending rearwards and disposed at a front end of the volute, where the limit plate and an outer wall of the volute enclose to form a first pipe slot.

In an embodiment, the wall-mounted air conditioner indoor unit further includes a wall-mount plate disposed at the chassis and detachably connected with the limit plate.

In an embodiment, the air duct assembly further includes a water receiving tray disposed at the mounting bracket.

In an embodiment, the chassis includes a second pipe slot extending along the up-down direction.

In an embodiment, the housing includes an air outlet panel covering the opening, and the air outlet panel is detachably connected with the mounting bracket, or the air outlet panel is detachably connected with the face frame, or the air outlet panel is detachably connected with the mounting bracket and the face frame.

In an embodiment, the face frame includes two side panels disposed at both ends of the chassis along a length direction respectively, and a lower edge of each side panel includes a flange, each flange is extended towards the other flange, and each of two ends of the air outlet panel is snap-fitted with a corresponding flange.

In an embodiment, each end of the air outlet panel includes a first snapping buckle, where each flange includes a first snapping slot, and each first snapping buckle is configured to be inserted in each first snapping slot.

In an embodiment, the air outlet panel is snap-fitted with the mounting bracket.

In an embodiment, the air outlet panel includes a second snapping buckle, where the mounting bracket includes a second snapping slot, and the second snapping buckle is configured to be inserted in the second snapping slot.

In an embodiment, the wall-mounted air conditioner indoor unit further includes a front panel movably connected with the face frame.

In an embodiment, a lower end of the front panel is detachably connected with the air outlet panel.

The present disclosure further provides a wall-mounted air conditioner including an outdoor unit and an indoor unit, where the indoor unit includes:

a housing including a face frame;

a chassis covering a rear side of the face frame to form an inner cavity having a downward opening; and an air duct assembly including a mounting bracket movably mounted to the chassis and detachably connected with the face frame, where the mounting bracket is configured to move into or out of the inner cavity through the opening of the inner cavity along an up-down direction.

In the embodiments of the present disclosure, the housing of the wall-mounted air conditioner indoor unit includes the face frame. The mounting bracket may be pulled out from the opening of the inner cavity when the air duct assembly needs to be maintained, replaced, or cleaned, thereby providing convenience for maintenance, replacement, or cleaning of the air duct assembly (including impeller, volute assembly, water receiving tray, etc.) and reduces after-sales maintenance costs. At the same time, the maintained, replaced, or cleaned air duct assembly may be pushed into the inner cavity along the chassis from the opening, and be connected with the face frame, thereby improving the installation stability of the air duct assembly. Therefore, the wall-mounted air conditioner indoor unit of the present disclosure is easy to disassemble, assemble, and clean, and has high installation reliability, which greatly improves user experience comfort.

BRIEF DESCRIPTION OF THE DRAWINGS

In order to more clearly illustrate the embodiments of the present disclosure, the drawings to be used in the description of the embodiments will be briefly described below. Obviously, the drawings in the following description are only some embodiments of the present disclosure, and other drawings may be obtained according to the structures shown in the drawings without any creative work for those skilled in the art.

DESCRIPTION OF REFERENCE NUMERALS

Figure 1:
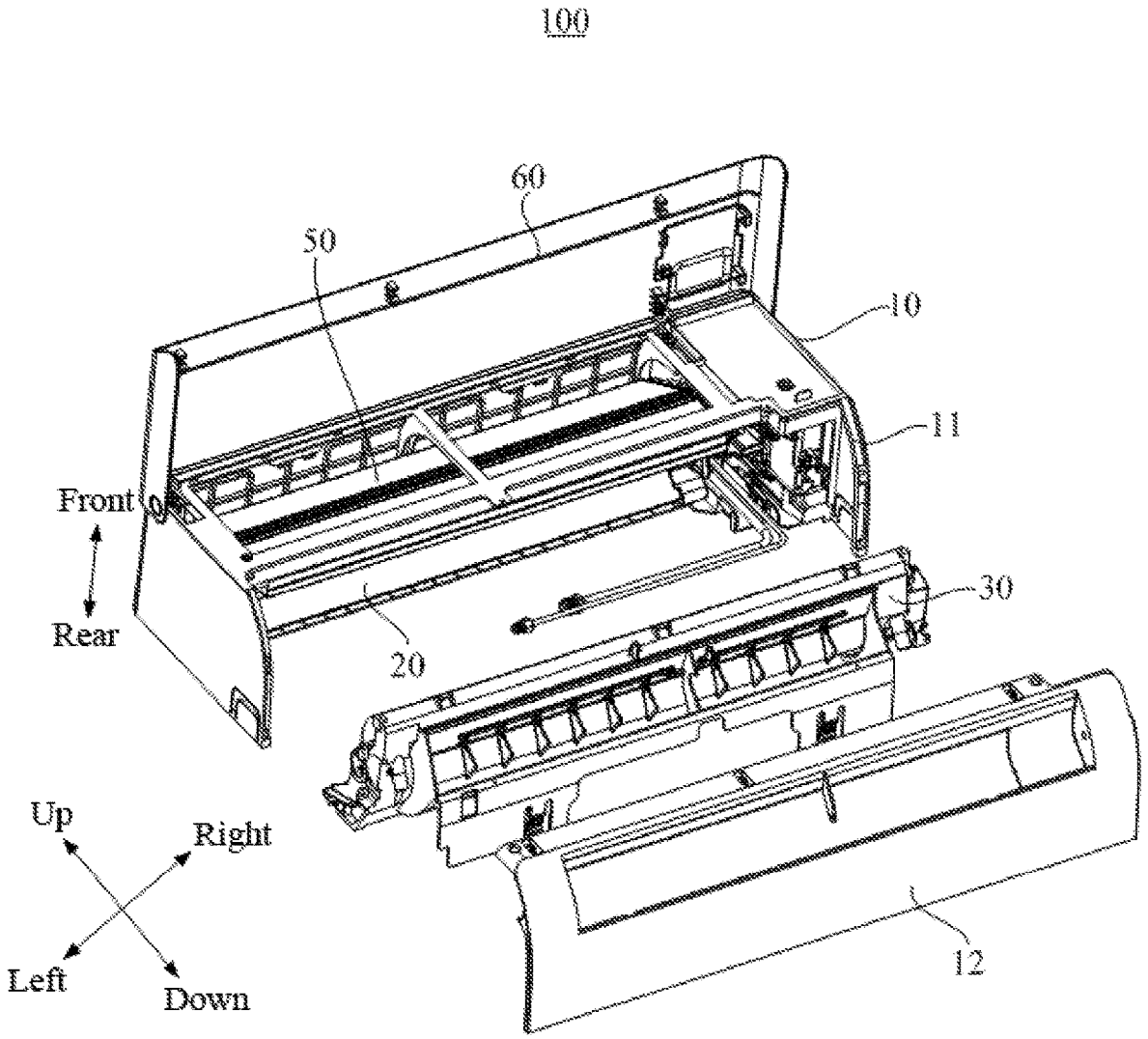
FIG. 1 is a schematic exploded structural view of a wall-mounted air conditioner indoor unit of the present disclosure.

| Reference Numeral | Name |
|---|---|
| 100 | Wall-mounted air conditioner indoor unit |
| 10 | Housing |
| 11 | Face frame |
| 111 | Face frame cross beam |
| 1111 | Third screw hole |
| 112 | Face frame side panel |
| 113 | Inner cavity |
| 114 | Flange |
| 115 | First snapping slot |
| 12 | Air outlet panel |
| 121 | First snapping buckle |
| 122 | Second snapping buckle |
| 20 | Chassis |
| 21 | Base plate |
| 22 | Side plate |
| 221 | Sliding slot |
| 222 | Front slot wall |
| 223 | Limit slot |
| 224 | Locking latch |
| 225 | Second pipe slot |
| 226 | Second screw hole |
| 30 | Air duct assembly |
| 31 | Impeller mounting bracket |
| 311 | Insertion member |
| 312 | Locking slot |
| 313 | First screw hole |
| 314 | Fourth screw hole |
| 315 | Second snapping slot |
| 32 | Cross-flow impeller |
| 33 | Volute assembly |
| 331 | Volute |
| 34 | Limit plate |
| 341 | First pipe slot |
| 35 | Water receiving tray |
| 36 | Motor |
| 40 | Wall-mount plate |
| 50 | Heat exchanger |
| 51 | Input/output pipe assembly |
| 52 | First pipe |
| 53 | Second pipe |
| 60 | Front panel |

DETAILED DESCRIPTION OF THE EMBODIMENTS

The technical solutions in the embodiments of the present disclosure will be described in the following with reference to the drawings in the embodiments of the present disclosure. It is obvious that the described embodiments are only some of the embodiments of the present disclosure, and not all of the embodiments. All other embodiments obtained by a person having ordinary skill in the art based on the embodiments of the present disclosure without making any creative work fall within the scope of the present disclosure.

It should be noted that, if there is a directional indicator (such as up, down, left, right, front, rear, etc.) in the embodiments of the present disclosure, it is only used to explain the relative position relationship and movement of the components in a particular attitude (as shown in the drawings), and if the specific attitude changes, the directional indicator will change accordingly.

In addition, if there is a description relating to "first," "second," etc., in the embodiments of the present disclosure, it is used for descriptive purposes only, and cannot be understood to indicate or imply its relative importance or to imply the number of technical features indicated. Thus, a feature associated with "first" or "second" may include at least one of the feature, either explicitly or implicitly. In addition, the meaning of "and/or" appearing throughout the disclosure includes three scenarios, taking "A and/or B" as an example, it includes the A scenario, or the B scenario, or the scenario in which both A and B are simultaneously satisfied.

In addition, the technical solutions of various embodiments can be combined with each other as long as they do not conflict with each other.

The present disclosure provides a wall-mounted air conditioner indoor unit.

Figure 2:
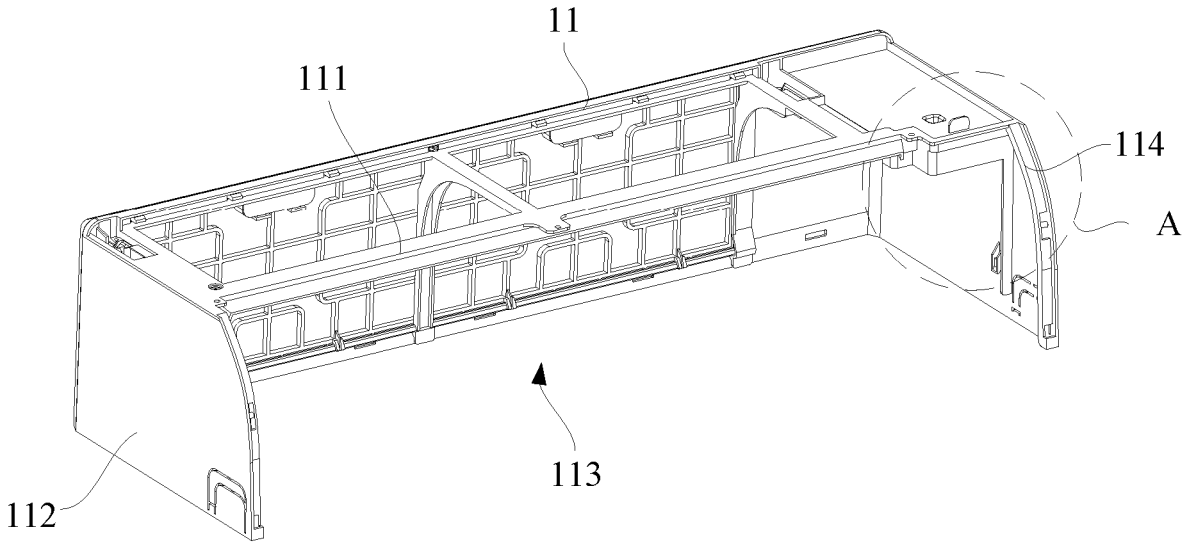
FIG. 2 is a schematic structural view of a face frame in FIG. 1.
Figure 3:
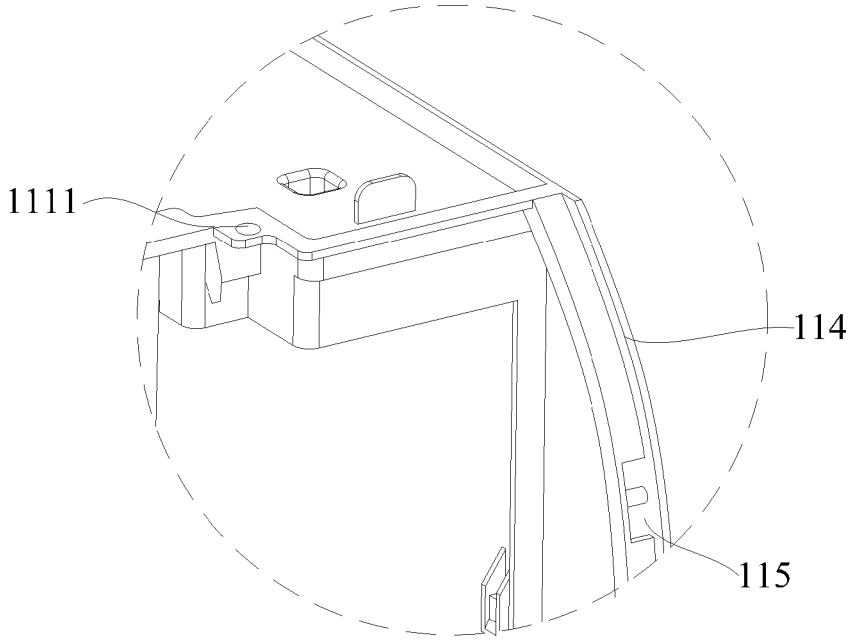
FIG. 3 is a partial enlarged view of a portion A in FIG. 2.
Figure 4:
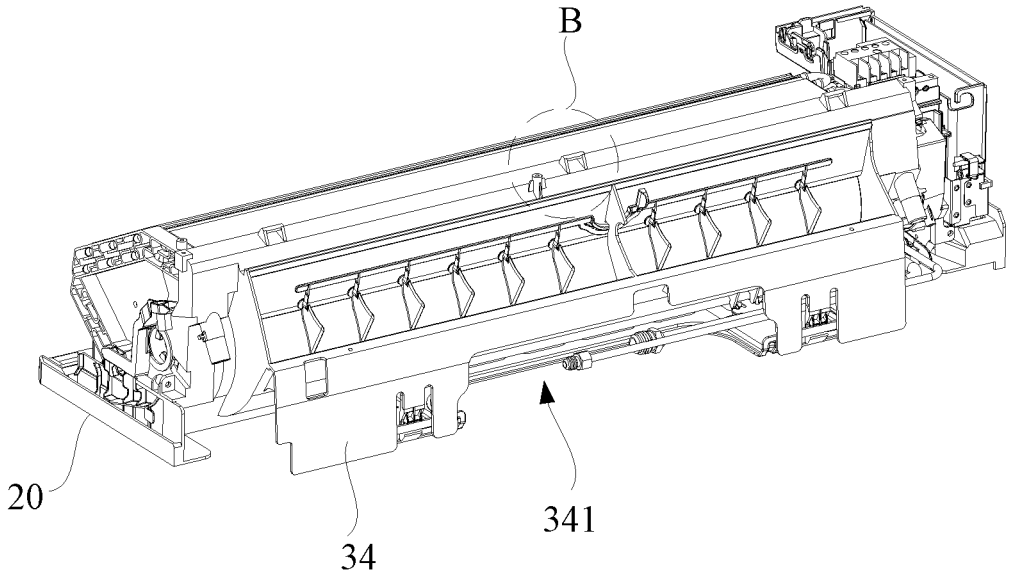
FIG. 4 is a schematic structural view showing an air duct assembly, a chassis, and a heat exchanger in FIG. 1 from a perspective after being assembled.
Figure 5:
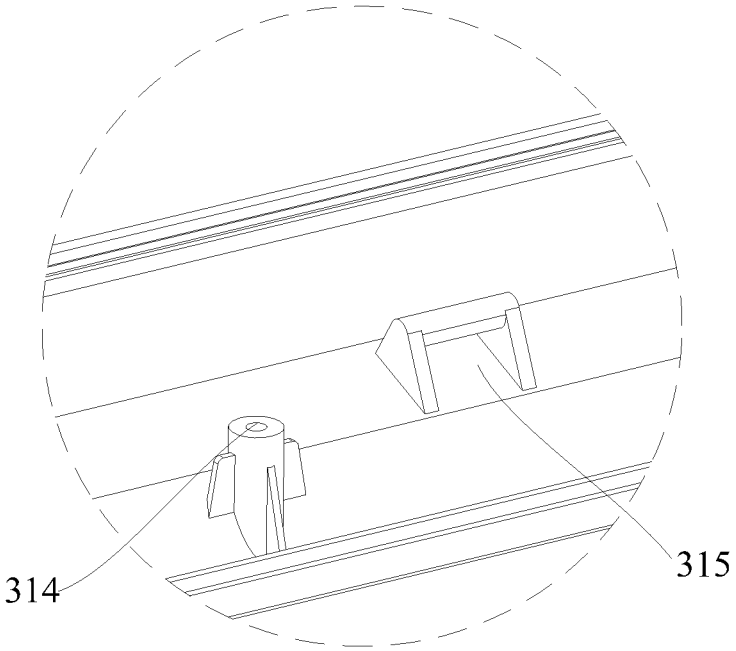
FIG. 5 is a partial enlarged view of a portion B in FIG. 4.
Figure 6:
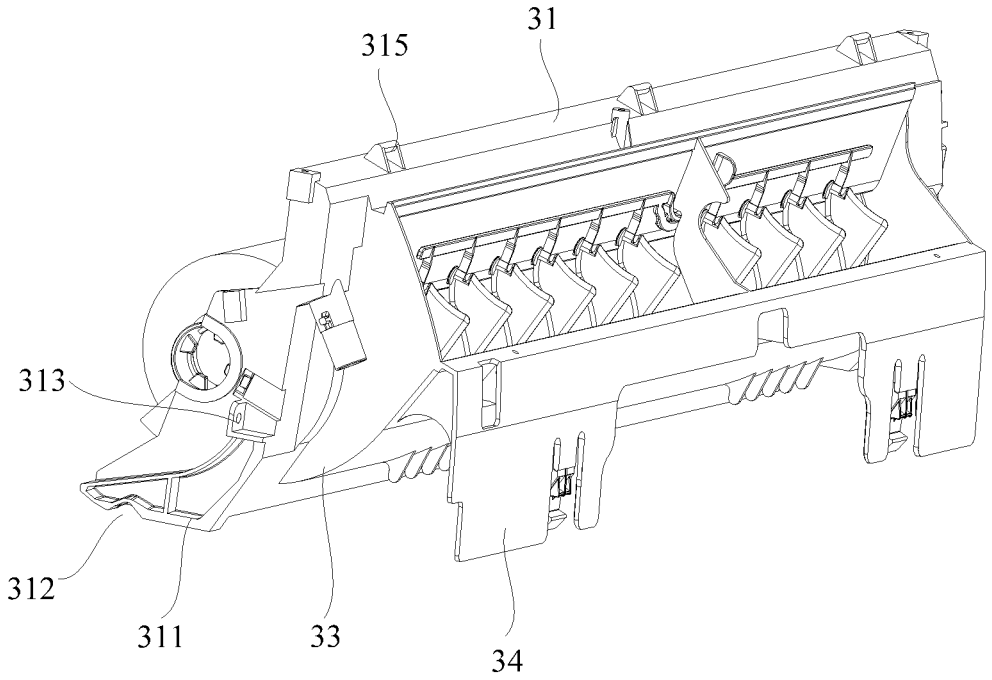
FIG. 6 is a schematic structural view showing the air duct assembly in FIG. 1 from a perspective.

Referring to FIGS. 1 to 3, the present disclosure provides a wall-mounted air conditioner indoor unit 100, which includes a housing 10, a chassis 20, and an air duct assembly 30. An air inlet is formed at a top of the housing 10, and an air inlet grill is disposed in the air inlet. An air outlet is formed at a front and lower side of the housing 10. The housing 10 includes a face frame 11. The chassis 20 covers a rear side of the face frame 11 and forms an inner cavity 113 having a downward opening. The air duct assembly 30 is received in the inner cavity 113, and the air duct assembly 30 includes an impeller mounting bracket 31 (as shown in FIG. 6), also referred to as "mounting bracket," movably mounted to the chassis 20 and detachably connected with the face frame 11, where the mounting bracket 31 is configured to move into or out of the inner cavity 113 through the opening of the inner cavity 113 along an up-down direction. The direction along which the mounting bracket 31 moves into or out of the inner cavity 113 through the opening of the inner cavity 113 is also referred to as an insertion direction of the mounting bracket 31.

Figure 7:
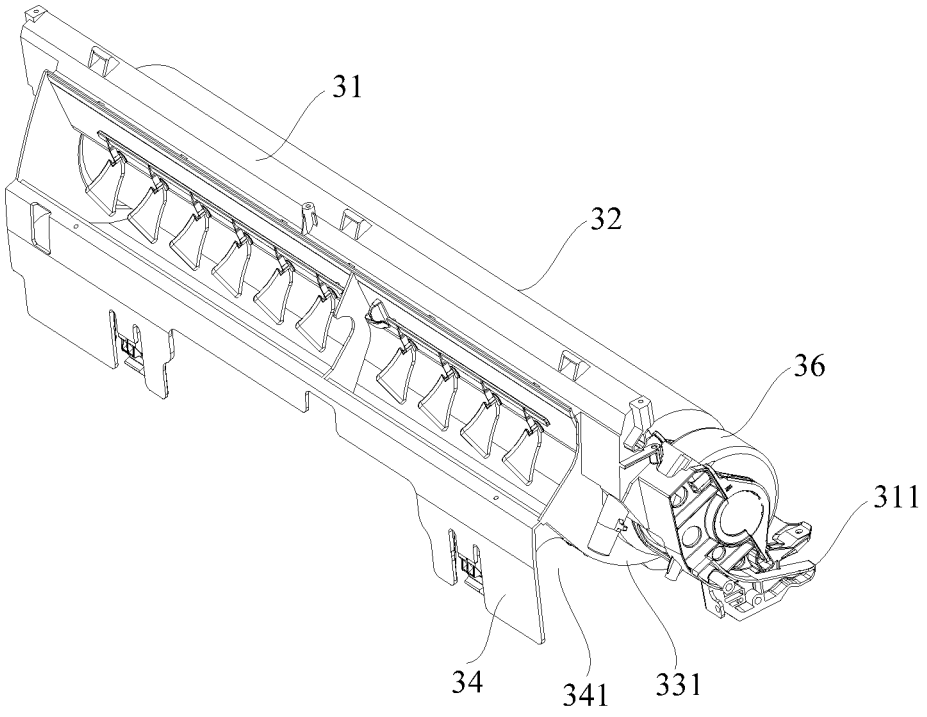
FIG. 7 is a schematic structural view showing the air duct assembly in FIG. 1 from another perspective.

In the embodiment of the present disclosure, the mounting bracket 31 may be movable along the chassis 20. Specifically, the chassis 20 may be provided with a guiding structure for guiding the mounting bracket 31, such as a sliding slot or a sliding rail. In some embodiments, the chassis 20 may not include a guiding structure, and in this case, the mounting bracket 31 may be movable along a wall of the chassis 20. The structure of the chassis 20 will be described in detail below. The mounting bracket 31 is mainly configured for mounting the impeller. Referring to FIG. 7, in some embodiments of the present disclosure, the air duct assembly 30 includes a cross-flow impeller 32, and the cross-flow impeller 32 is mounted at the mounting bracket 31. The cross-flow impeller 32 may be taken out when the mounting bracket 31 is pulled downward from the opening, thereby facilitating maintenance, replacement, or cleaning of the cross-flow impeller 32 by a user or an after-sales person. The air duct assembly 30 further includes a motor 36 which is mounted at the mounting bracket 31 and located at one end of the cross-flow impeller 32 to drive the cross-flow impeller 32 to rotate.

Figure 8:
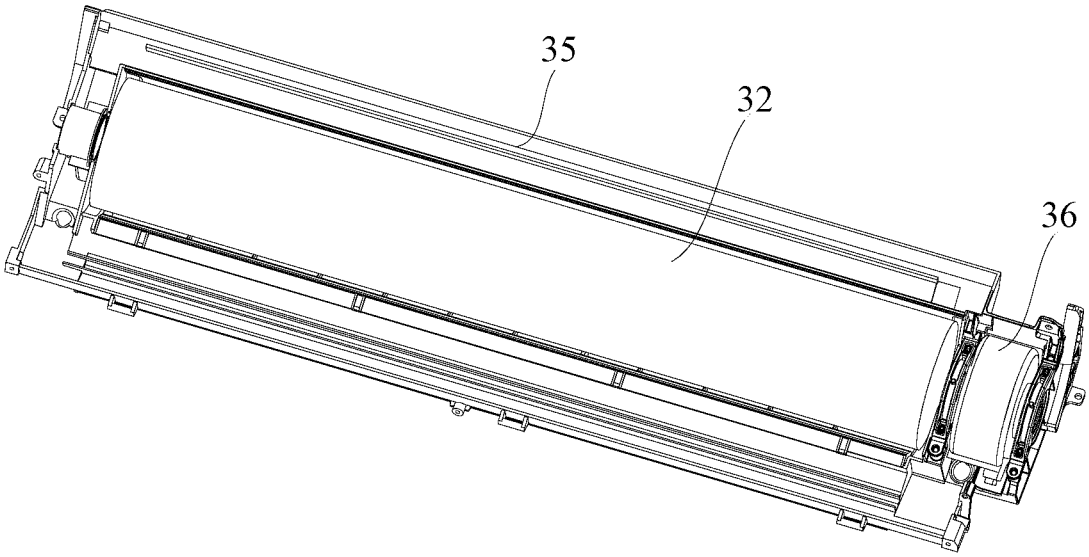
FIG. 8 is a schematic structural view showing the air duct assembly in FIG. 1 from still another perspective.

In addition, referring to FIGS. 6 and 7, the air duct assembly 30 further includes a volute assembly 33 which is disposed at the mounting bracket 31. Specifically, the volute assembly 33 includes a volute 331 and a volute tongue (not labeled), the volute 331 and the volute tongue enclose to form a cross-flow air duct for installation of the cross-flow impeller 32. The volute assembly 33 may be integrally formed with the mounting bracket 31. In some embodiments, the volute assembly 33 and the mounting bracket 31 may also be separate parts (e.g., detachably connected with other), which is not specifically limited here. Further, referring to FIG. 8, the air duct assembly 30 further includes a water receiving tray 35, and the water receiving tray 35 is disposed at the mounting bracket 31. Similarly, the water receiving tray 35 may be integrally formed with the mounting bracket 31. In some embodiments, the water receiving tray 35 and the mounting bracket 31 may also be separate parts. Specifically, the water receiving tray 35 includes a front water receiving slot and a rear water receiving slot. In some embodiments of the present disclosure, the wall-mounted air conditioner indoor unit 100 further includes a heat exchanger 50 (as shown in FIG. 1), and the heat exchanger 50 is mounted at the chassis 20. Specifically, the heat exchanger 50 is screwed with or snap fitted with the chassis 20. The heat exchanger 50 may be a multi-fold heat exchanger 50 and disposed corresponding to the cross-flow impeller 32. The water receiving tray 35 is disposed below the heat exchanger 50 for receiving the condensed water from the heat exchanger 50.

In some embodiments of the present disclosure, the housing 10 of the wall-mounted air conditioner indoor unit 100 includes a face frame 11, and the face frame 11 includes the inner cavity 113 having a downward opening. The chassis 20 is mounted inside the inner cavity 113. The air duct assembly 30 includes the mounting bracket 31. The mounting bracket 31 is movably mounted to the chassis 20, and is detachably connected with the face frame 11. The mounting bracket 31 is able to be moved into or out of the inner cavity 113 through the opening of the inner cavity 113 along an up-down direction. Thus, the mounting bracket 31 may be pulled out from the opening of the inner cavity 113 when the air duct assembly 30 needs to be maintained, replaced, or cleaned, thereby providing convenience for maintenance, replacement, or cleaning of the air duct assembly 30 (including impeller, volute assembly 33, water receiving tray 35, etc.) and reducing after-sales maintenance costs. At the same time, the maintained, replaced, or cleaned air duct assembly 30 may be pushed upwards into the inner cavity 113 along the chassis 20 from the opening, and be connected with the face frame 11, thereby improving the installation stability of the air duct assembly 30. Therefore, the wall-mounted air conditioner indoor unit 100 of the present disclosure is easy to disassemble, assemble, and clean, and has high installation reliability, which greatly improves user experience comfort.

Referring to FIGS. 6 to 12, in some embodiments, in order to facilitate the dismounting and mounting of the mounting bracket 31, the mounting bracket 31 includes an insertion member 311, the chassis 20 includes a sliding slot 221, and the insertion member 311 is movable in the sliding slot 221.

Figure 11:
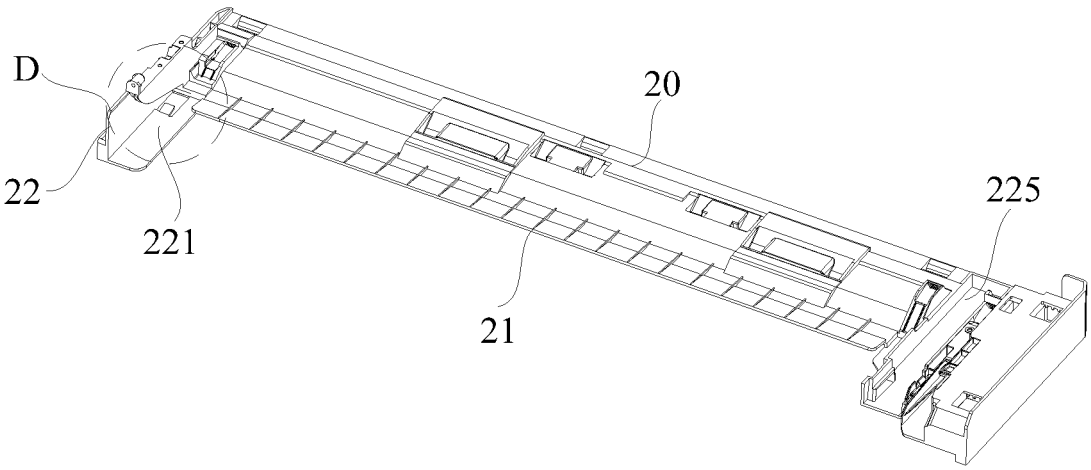
FIG. 11 is a schematic structural view of the chassis in FIG. 1.
Figure 12:
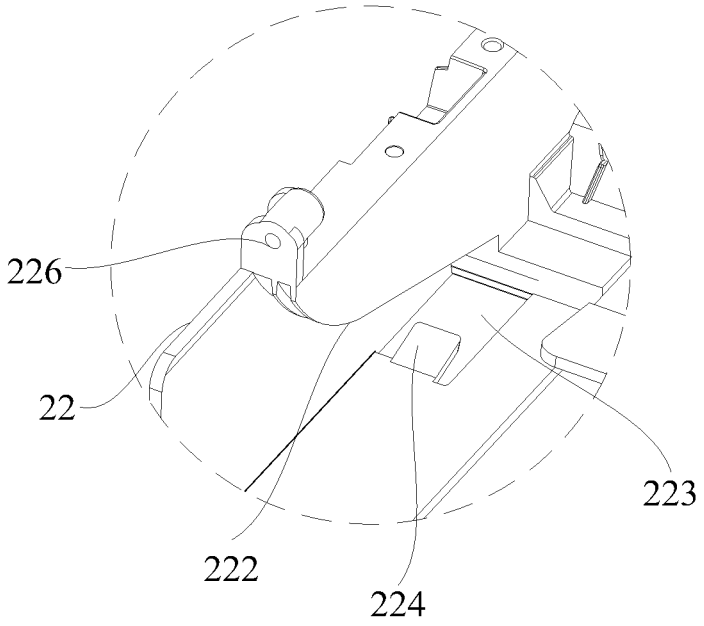
FIG. 12 is a partial enlarged view of a portion D in FIG. 11.

Specifically, referring to FIGS. 11 and 12, the chassis 20 includes a base plate 21 and two side plates 22 extending forwards from two ends of the base plate 21, respectively, where the sliding slot 221 is one of two sliding slots 221, and each sliding slot 221 is formed at a corresponding side plate 22. The sliding slot 221 may be formed in various manners, for example, the sliding slot 221 may be depressed from the side plate 22; for another example, the one side plate 22 extends toward the other side plate 22 to form a limit portion, and the limit portion, the side plate 22, and the base plate 21 enclose to form the sliding slot 221. Each end of the mounting bracket 31 may be provided with an insertion member 311 corresponding to a sliding slot 221 (as shown in FIGS. 6 and 7). In this way, the insertion member 311 of the mounting bracket 31 may be slidably mounted in the sliding slot 221, so that on the one hand the dismounting and mounting of the mounting bracket 31 may be more convenient, and on the other hand it may be ensured that the mounting bracket 31 may move along the preset trajectory, which ensures that the mounting bracket 31 is mounted in position, thereby improving the installation reliability of the mounting bracket 31.

In order to prevent the mounting bracket 31 from falling, the mounting bracket 31 may be locked and fixed with the chassis 20. For example, referring to FIGS. 9 to 12, each of the two ends of the base plate 21 includes a limit slot 223 adjacent to the corresponding sliding slot 221, and a locking latch 224 is disposed in each limit slot 223; the insertion member 311 includes a locking slot 312 corresponding to a locking latch 224 (as shown in FIG. 6). In this way, when the mounting bracket 31 is mounted, an upper end of each insertion member 311 is locked in a limit slot 223, and each locking latch 224 is locked in a locking slot 312 (as shown in the FIG. 10), so that the mounting bracket 31 may be locked and fixed with the chassis 20. When the mounting bracket 31 needs to be dismounted, the mounting bracket 31 may be detached from the chassis 20 by applying a downward pulling force to the mounting bracket 31.

Further, in order to prevent the mounting bracket 31 from falling, the mounting bracket 31 may also be screwed with the chassis 20. Specifically, each of two ends of the mounting bracket 31 includes a first screw hole 313 (as shown in FIG. 6), and each of the two side plates 22 includes a second screw hole 226 (as shown in FIG. 12), and the mounting bracket 31 may be fixed with the chassis 20 by a screw inserted in the first screw hole 313 and a corresponding second screw hole 226.

In some embodiments of the present disclosure, the sliding slot 221 defines a sliding trajectory of the insertion member 311, namely, defines a dismount trajectory of the mounting bracket 31. In order to avoid the occurrence of scratching of an input/output pipe assembly 51 of the heat exchanger 50 during the dismounting of the mounting bracket 31, the sliding trajectory may be inclined from a rear upper side toward a front lower side. Specifically, referring to FIG. 12, the sliding slot 221 includes a front slot wall 222 (namely the limit portion mentioned above) inclined forwards from top to bottom, and an angle $\alpha$ between the front slot wall 222 and a vertical direction (e.g., an extension direction of the sliding slot 221) is at least 0° and at most 89°.

Figure 9:
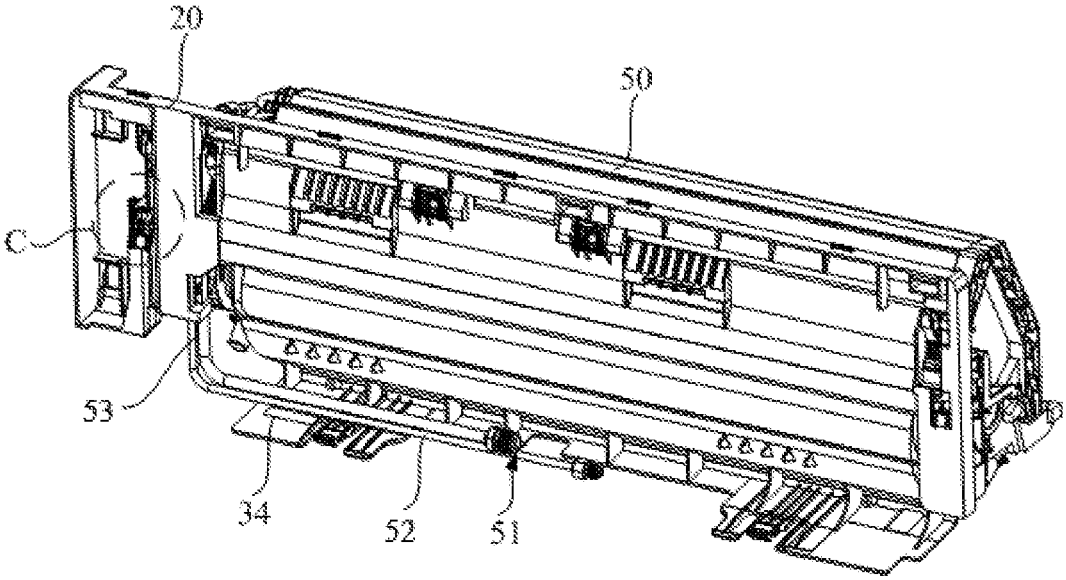
FIG. 9 is a schematic structural view showing an air duct assembly, a chassis, and a heat exchanger in FIG. 1 from another perspective after being assembled.
Figure 10:
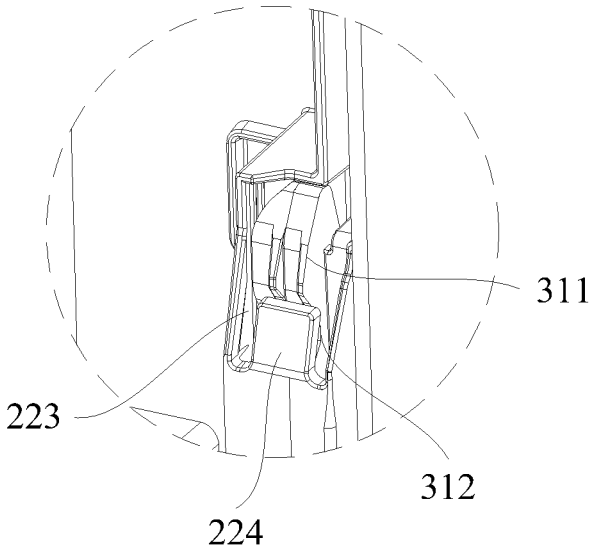
FIG. 10 is a partial enlarged view of a portion C in FIG. 9.

Referring to FIG. 9, the heat exchanger 50 includes the input/output pipe assembly 51 that includes a first pipe 52 and a second pipe 53. The first pipe 52 extends along a length direction of the heat exchanger 50 (left-right direction), and the second pipe 53 extends along an up-down direction. In order to avoid the occurrence of scratching of the input/output pipe assembly 51 during the dismounting and mounting of the air duct assembly 30, a limit plate 34 extending rearwards is disposed at a front end of the volute 331, and the limit plate 34 and an outer wall of the volute 331 enclose to form a first pipe slot 341 (as shown in FIG. 7), where the first pipe slot 341 is configured to accommodate the first pipe 52. In addition, the chassis 20 includes a second pipe slot 225 extending along an up-down direction (as shown in FIG. 11), and second pipe slot 225 is configured to accommodate the second pipe 53.

Figure 13:
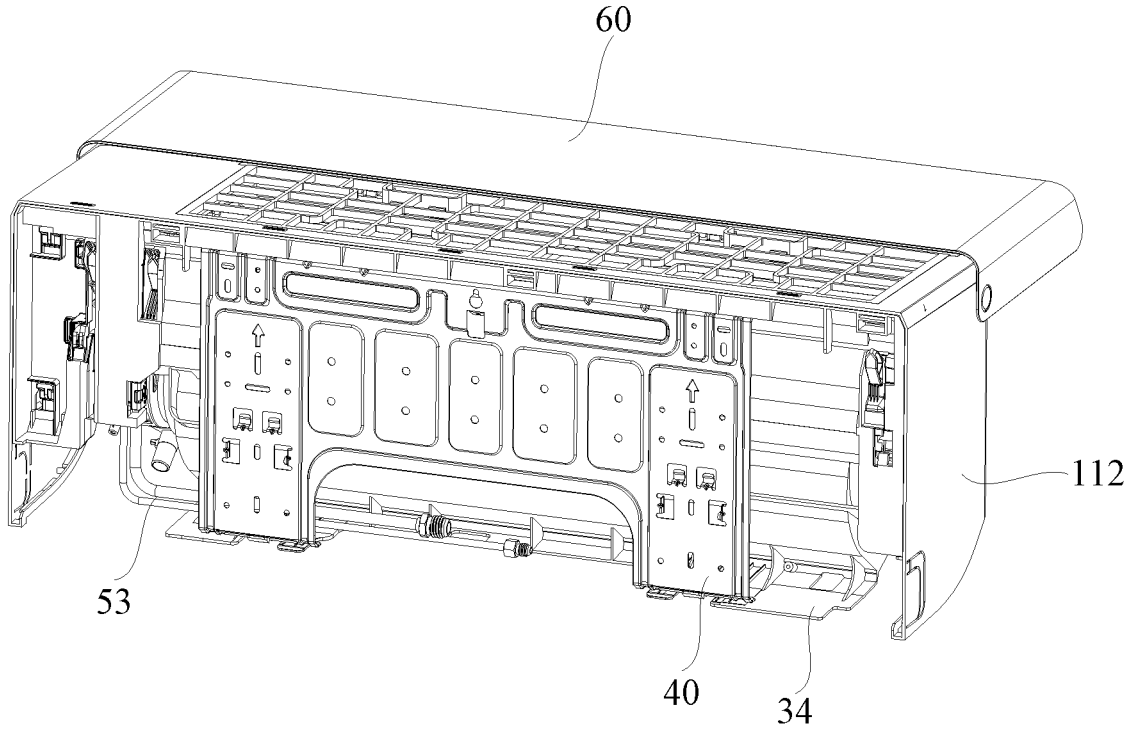
FIG. 13 is a detailed assembly view of the air duct assembly and a wall-mount plate in FIG. 1.

Further, referring to FIG. 13, in some embodiment, the wall-mounted air conditioner indoor unit 100 further includes a wall-mount plate 40 disposed at the chassis 20 and detachably connected with the limit plate 34. There are various ways of detachable connection between the wall-mount plate 40 and the limit plate 34, and no special restriction is made herein. For example, the wall-mount plate 40 and the limit plate 34 may be connected by a snap mechanism. The snap mechanism includes a snapping slot and a snapping buckle, where the snapping slot is disposed at the limit plate 34 and the snapping buckle is disposed at the wall-mount plate 40, or, the snapping buckle is disposed at the limit plate 34 and the snapping slot is disposed at the wall-mount plate 40.

There are also various ways of detachable connection between the mounting bracket 31 and the face frame 11. For example, the mounting bracket 31 may be snap fit, magnetically connected, or screwed with the face frame 11. Referring to FIGS. 2 to 5, the face frame 11 includes a face frame cross beam 111 extending along a length direction of the housing 10, and the mounting bracket 31 is screwed or snap-fitted with the face frame cross beam 111. Specifically, the face frame cross beam 111 includes a third screw hole 1111, and the mounting bracket 31 includes a fourth screw hole 314, and the face frame cross beam 111 is fixedly connected with the mounting bracket 31 by a screw inserting into the third screw hole 1111 and the fourth screw hole 314. A plurality of the third screw holes 1111 may be provided, and spaced apart along a length direction of the face frame cross beam 111; a number of the fourth screw holes 314 corresponds to a number of the third screw holes 111. Here, the length direction of the face frame 11 can be a left-right direction shown in the figures.

Figure 14:
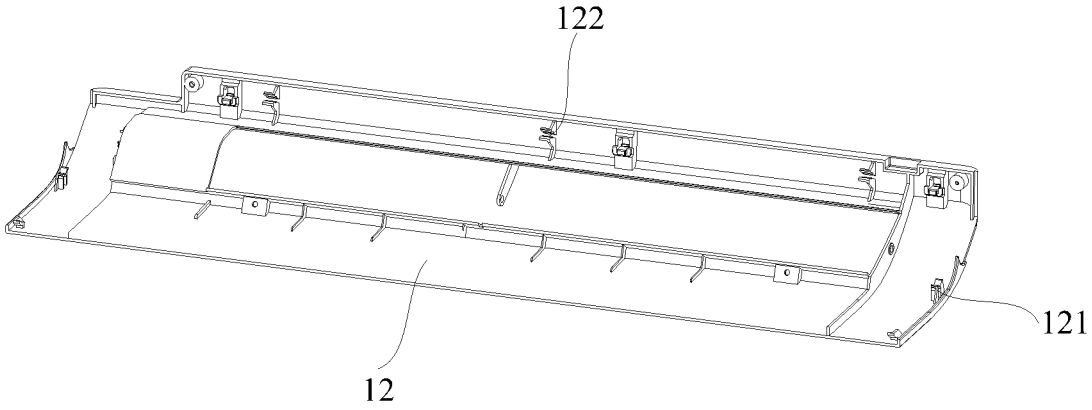
FIG. 14 is a schematic structural view of an air outlet panel in FIG. 1.

Referring to FIG. 14, on the basis of the above embodiments, the housing 10 includes an air outlet panel 12, and the air outlet panel 12 includes the air outlet. The air outlet panel 12 covers the opening, where the air outlet panel 12 is detachably connected with the mounting bracket 31, or the air outlet panel is detachably connected with the face frame 11, or the air outlet panel 12 is detachably connected with the mounting bracket 31 and the face frame 11.

In some embodiments, the air outlet panel 12 may be detachably connected with the face frame 11. Thus, when the mounting bracket 31 needs to be dismounted, the air outlet panel 12 is first detached from the face frame 11, and then the mounting bracket 31 is pulled downwards from the opening.

There are various ways of detachable connection between the air outlet panel 12 and the face frame 11, for example, the air outlet panel 12 may be snap-fitted with the face frame 11. Referring to FIG. 2 and FIG. 3, the face frame 11 includes two face frame side panels 112 disposed at two end of the chassis 20 along a length direction respectively, each face frame side panel 112 includes a flange 114 at a lower edge thereof and extending toward the other face frame side panel 112, and each end of the air outlet panel 12 is snap-fitted with a flange 114. Specifically, a first snapping buckle 121 is disposed at each end of the air outlet panel 12, each flange 114 includes a first snapping slot 115, and the first snapping buckle 121 is inserted in the corresponding first snapping slot 115. For another example, the air outlet panel 12 may be screwed with the face frame 11. Specifically, the air outlet panel 12 and the face frame 11 include corresponding holes, and the air outlet panel 12 and the face frame 11 are fixedly connected by screws inserted in the corresponding holes.

In some embodiment, the air outlet panel 12 may be detachably connected with the mounting bracket 31. In this way, when the mounting bracket 31 needs to be dismounted, the air outlet panel 12 and the mounting bracket 31 may be first pulled out as a whole from the opening, and then the mounting bracket 31 may be further detached from the air outlet panel 12. Specifically, the air outlet panel 12 may be snap-fitted with the mounting bracket 31. Optionally, referring to FIG. 4, FIG. 5, and FIG. 14, a second snapping buckle 122 is disposed at the air outlet panel 12, the mounting bracket 31 includes a second snapping slot 315, and the second snapping buckle 122 is inserted in the second snapping slot 315. In order to increase the assembly reliability between the air outlet panel 12 and the mounting bracket 31, a plurality of the second snapping buckles 122 may be provided, and spaced apart along a length direction of the air outlet panel 12 (left-right direction).

It should be understood that, in another embodiment, the air outlet panel 12 may be detachably connected with the mounting bracket 31, and the air outlet panel 12 may be detachably connected with the face frame 11. Thus, when the mounting bracket 31 needs to be dismounted, the air outlet panel 12 may be first detached from the face frame 11, and then the mounting bracket 31 may be pulled downwards from the opening. For brevity, the ways of detachable connection between the air outlet panel 12 and the mounting bracket 31, and the ways of detachable connection between the air outlet panel 12 and the face frame 11 are not repeated here.

Figure 15:
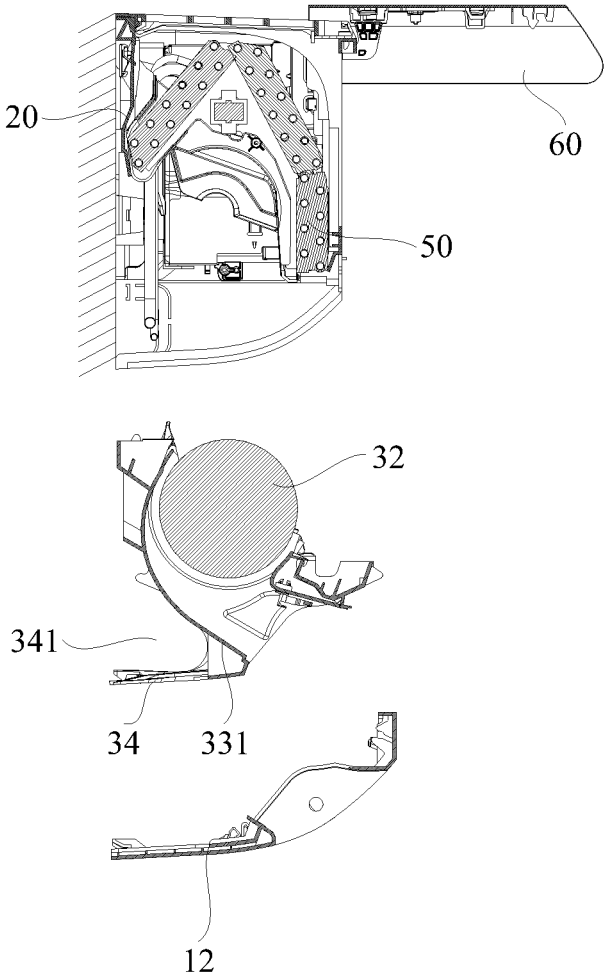
FIG. 15 is a schematic view showing disassembly and assembly of the wall-mounted air conditioner indoor unit according to an embodiment of the present disclosure.
Figure 16:
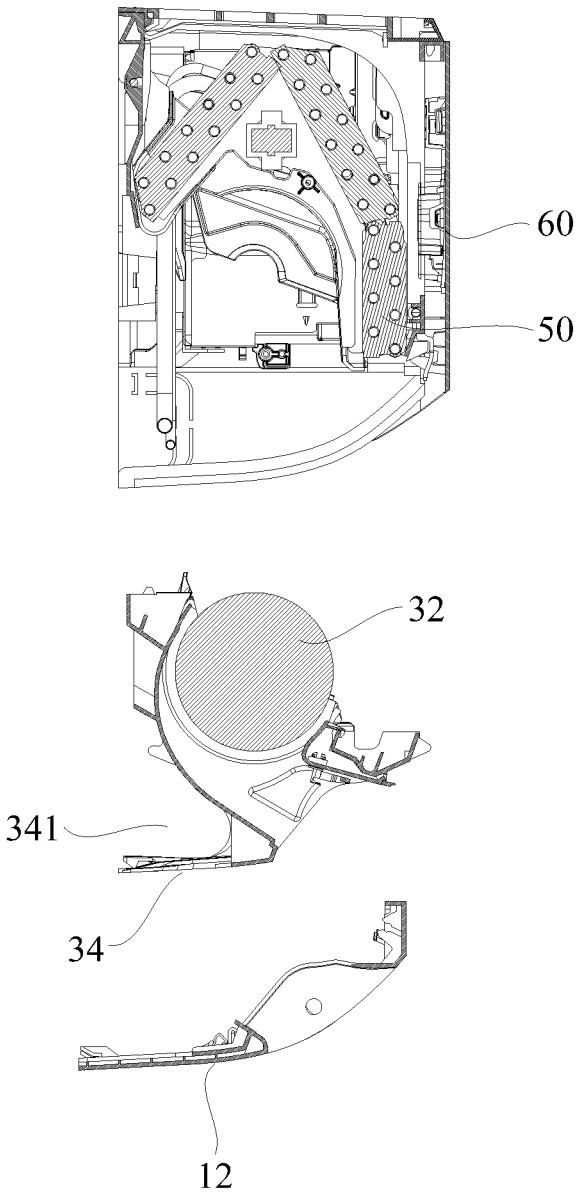
FIG. 16 is a schematic view showing disassembly and assembly of the wall-mounted air conditioner indoor unit according to another embodiment of the present disclosure.

Further, referring to FIGS. 15 and 16, the wall-mounted air conditioner indoor unit 100 includes a front panel 60 movably connected with the face frame 11. The front panel 60 may be rotatably or slidably connected with the face frame 11. Hereinafter, taking the front panel 60 being rotatably connected with the face frame 11 as an example for introduction. Referring to the FIG. 1, an upper end of the front panel 60 is rotatably connected with the face frame 11.

In some embodiments, in order to improve the installation reliability and stability of the air duct assembly 30 and make the wall-mounted air conditioner indoor unit 100 have a more aesthetically appealing shape, the front panel 60 may be detachably connected with the air outlet panel 12. Specifically, referring to FIG. 15, a lower end of the front panel 60 is detachably connected with the air outlet panel 12, so that when the mounting bracket 31 needs to be dismounted, the front panel 60 is first rotated upwards, so that the front panel 60 is separated from the air outlet panel 12. Then, the air outlet panel 12 is detached from the face frame 11. Finally, the mounting bracket 31 is pulled downwards from the opening.

In some other embodiments, the front panel 60 and the air outlet panel 12 may not have any connection relationship, and the front panel 60 does not interfere with the dismounting of the air outlet panel 12. Specifically, referring to FIG. 16, a lower end of the front panel 60 is spliced with the air outlet panel 12. In this way, when the mounting bracket 31 needs to be dismounted, there is no need to rotate the front panel 60 upwards, the air outlet panel 12 is first detached from the face frame 11, and then the mounting bracket 31 is pulled downwards from the opening.

The present disclosure further provides a wall-mounted air conditioner, which includes an outdoor unit and an indoor unit. For the specific structure of the indoor unit, reference can be made to the above embodiments, since the air conditioner adopts all of the technical solutions of the above embodiments, it at least has all the beneficial effects brought about by the technical solutions of the above embodiments, and will not be further described here.

The above description refers to only optional embodiments of the present disclosure, and does not limit the scope of the present disclosure, and any transformation of equivalent structure made under the concept of the present disclosure by using the contents of this specification and the drawings, or direct/indirect application in other relevant technical fields, shall be included in the scope of the present disclosure.

What is claimed is:

1. An air conditioner indoor unit, comprising:

a housing including a face frame including an inner cavity having an opening;

a chassis covering a side of the face frame; and an air duct assembly including a mounting bracket movably mounted at the chassis and detachably connected with the face frame, the mounting bracket being configured to move into or out of the inner cavity through the opening of the inner cavity along an insertion direction.

2. The air conditioner indoor unit according to claim 1, wherein:

the face frame includes a cross beam extending along a length direction of the housing; and the mounting bracket is screwed or snap-fitted with the cross beam.

3. The air conditioner indoor unit according to claim 1, wherein:

the chassis includes a sliding slot; and the mounting bracket includes an insertion member movable in the sliding slot.

4. The air conditioner indoor unit according to claim 3, wherein:

the chassis further includes:

a base plate; and a side plate extending from an end of the base plate; and the sliding slot is formed at the side plate.

5. The air conditioner indoor unit according to claim 4, wherein the end of the base plate includes:

a limit slot adjacent to the sliding slot; and a locking latch disposed in the limit slot; and the insertion member includes a locking slot configured to cooperate with the locking latch.

6. The air conditioner indoor unit according to claim 4, wherein:

wherein:

an end of the mounting bracket includes a first screw hole; and the side plate includes a second screw hole corresponding to the first screw hole;

the air conditioner indoor unit further comprising:

a screw configured to be inserted in the first screw hole and the second screw hole to fix the mounting bracket with the chassis.

7. The air conditioner indoor unit according to claim 3, wherein the sliding slot includes an inclined slot wall inclined forwards from top to bottom, an angle between the inclined slot wall and an extension direction of the sliding slot being at least 0° and at most 89°.

8. The air conditioner indoor unit according to claim 1, wherein the air duct assembly further includes a volute assembly disposed at the mounting bracket.

9. The air conditioner indoor unit according to claim 8, wherein the volute assembly includes: a volute; and a limit plate disposed at one end of the volute and extending in a direction perpendicular to the insertion direction.

10. The air conditioner indoor unit according to claim 9, further comprising:

a wall-mount plate disposed at the chassis and detachably connected with the limit plate.

11. The air conditioner indoor unit according to claim 1, wherein the air duct assembly further includes a water receiving tray disposed at the mounting bracket.

12. The air conditioner indoor unit according to claim 1, wherein the chassis includes a pipe slot extending along the insertion direction.

13. The air conditioner indoor unit according to claim 1, wherein the housing further includes an air outlet panel configured to cover the opening, the air outlet panel being detachably connected with at least one of the mounting bracket or the face frame.

14. The air conditioner indoor unit according to claim 13, wherein:

the face frame includes a side panel disposed at an end of the chassis;

a lower edge of the side panel includes a flange extending towards another end of the chassis opposite to the end of the chassis; and an end of the air outlet panel is snap-fitted with the flange.

15. The air conditioner indoor unit according to claim 14, wherein:

the flange includes a snapping slot; and the end of the air outlet panel includes a snapping buckle configured to be inserted in the snapping slot.

16. The air conditioner indoor unit according to claim 13, wherein the air outlet panel is snap-fitted with the mounting bracket.

17. The air conditioner indoor unit according to claim 16, wherein:

the mounting bracket includes a snapping slot; and the air outlet panel includes a second snapping buckle configured to be inserted in the snapping slot.

18. The air conditioner indoor unit according to claim 13, further comprising:

a front panel movably connected with the face frame.

19. The air conditioner indoor unit according to claim 18, wherein a lower end of the front panel is detachably connected with the air outlet panel.

20. A wall-mounted air conditioner, comprising:

an indoor unit including:

a housing including a face frame including an inner cavity having an opening;

a chassis covering a side of the face frame; and an air duct assembly including a mounting bracket movably mounted at the chassis and detachably connected with the face frame, the mounting bracket being configured to move into or out of the inner cavity through the opening of the inner cavity.

* * * * *